United States Patent [19]

Cohen

[11] Patent Number: 4,981,065

[45] Date of Patent: Jan. 1, 1991

[54] COWBELL WITH STRIKING RIDGE

[75] Inventor: Wayne E. Cohen, Pomona, N.Y.

[73] Assignee: Latin Percussion, Garfield, N.J.

[21] Appl. No.: 438,664

[22] Filed: Nov. 17, 1989

[51] Int. Cl.[5] ..... G10D 13/06

[52] U.S. Cl. ..... 84/402; 84/406

[58] Field of Search ..... 84/402 R, 406

[56] References Cited

U.S. PATENT DOCUMENTS 352,794 11/1886 Widdows ..... 84/406

4,362,080 12/1982 De Armas ..... 84/406

4,779,507 10/1988 Fujioka ..... 84/402 R 4,898,061 2/1990 Cohen et al. ..... 84/402

*Primary Examiner*—Lawrence R. Franklin

*Attorney, Agent, or Firm*—Brumbaugh, Graves, Donohue & Raymond

[57] ABSTRACT

A musical cow-bell is provided with a striking ridge of high impact plastic. The ridge provides versatility in playing, protection against damage to the bell or drumsticks and improved tone.

8 Claims, 1 Drawing Sheet

COWBELL WITH STRIKING RIDGE

BACKGROUND OF THE INVENTION

This invention relates to bell-type percussion instruments, and particularly to an instrument known as the cow-bell. The known cow-bell instrument is a hollow metal rectangular bell having a closed end and an open end. The instrument is mounted by a clamping arrangement attached to its closed end. The longer edge of the open end is struck by a striking member, such as a drumstick, to cause the instrument to produce a distinctive cow-bell tone.

Because the prior art cow-bell is struck along the rather sharp, hard metal edge of the open end, repeated striking can damage the drumstick or deform the bell, particularly when used by musicians playing vigorous rock and roll music. Further, the prior art cow-bell must be struck within a very limited range of angles to produce the desired tone, and improper blows can result in undesireable overtones. In practice some musicians attempt to reduce such overtones by wrapping the open end of the cow-bell with tape.

In the commonly-owned, allowed U.S. patent application, Ser. No. 252,861, filed Sept. 30, 1988, now U.S. Pat. No. 4,898,061, granted Feb. 6, 1990, entitled "Block Type Percussion Instrument" there is described a percussion instrument formed entirely of molded plastic, which in a preferred embodiment includes an integrally molded plastic striking ridge along the upper edge of the block. This instrument is prior art to this application by reason of sales by the assignee of the present invention. This integrally molded striking ridge of the prior art block is not suitable for application to a cow-bell which requires a sheet metal body to produce its distinctive tone.

It is therefore an object of the present invention to provide an improved bell-type percussion instrument which avoids damage to drumsticks or the instrument as a result of vigorous usage by musicians.

It is a further object of the invention to provide an improved cow-bell which produces the desired tone over a wide range of striking angles without undesireable overtones.

SUMMARY OF THE INVENTION

In accordance with the present invention there is provided an improved bell-type percussion instrument, such as a cow-bell, having a hollow body with a closed end and an open end. In accordance with the invention a striking ridge is arranged along a portion of the open end and is rigidly attached to the body for conveying mechanical vibrations to the body from the impact of a striking member to the striking ridge.

In a preferred arrangement of a sheet metal cow-bell with a generally rectangular open end, the ridge is mechanically attached to the body of the cow-bell along one of the longer sides of the open end. Preferably the ridge is formed as a solid piece of high impact molded plastic having one side shaped to conform to the exterior surface of the body and an outwardly facing side which is tapered toward the closed end and rounded toward the open end.

For a better understanding of the present invention, together with other and further objects, reference is made to the following description, taken in conjunction with the accompanying drawings and its scope will be pointed out in the appended claims.

DESCRIPTION OF THE PREFERRED EMBODIMENT

Figure 1:
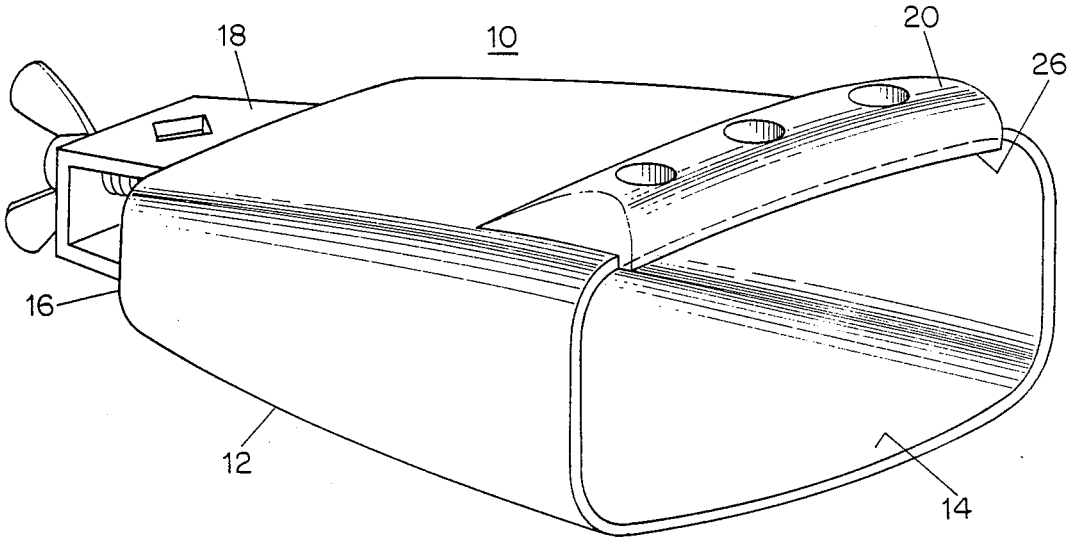
FIG. 1 is a perspective view of a cow-bell instrument in accordance with the present invention.
Figure 2:
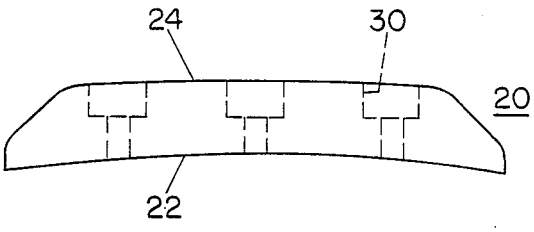
FIG. 2 is a side view of the striking ridge of the FIG. 1 instrument.

FIG. 1 is a perspective view of a cow-bell 10 in accordance with the present invention. Cow-bell 10 is formed of sheet metal, such as steel and comprises a hollow body 12 of generally rectangular cross-section having an open end 14 and a closed end 16. A mounting clamp arrangement 18 of conventional design is fixed to closed end 16 for purposes of mounting bell 10 to a rack or other supporting device.

Figure 3:
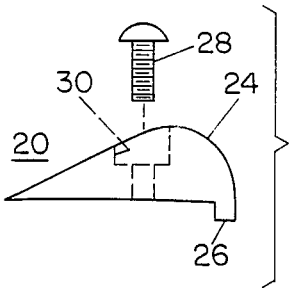
FIG. 3 is an end view of the striking ridge of FIG. 2.

In accordance with the present invention, cow-bell 10 is provided with a striking ridge 20 formed of high density polyethylene plastic. Ridge 20 is molded on its lower surface 22 to conform to the exterior shape of one of the long sides of the open end 14 of cow-bell 10. Ridge 20, as shown in FIG. 3, preferably includes a flange portion 26 which overlies the edge of cow-bell open end 14 to position ridge 20. The upper, outwardlY facing surface 24 of ridge 20 rounded toward open end 14 and tapered toward closed end 16. In a typical application ridge 20 extends 1 inch from open end 14 toward closed end 16 and has a maximum thickness of about one-half inch. Ridge 20 is firmly mounted to the upper surface of bell 10 by use of metal or plastic rivets 28 which extend through counterbored holes 30 formed in ridge 20. Other suitable mounting techniques may be used to provide rigid, vibration-conducting connection between ridge 20 and bell 10.

Ridge 20, attached to the cow-bell 10 as shown, provides a convenient and durable striking surface which avoids damage to drumsticks and to the bell from energetic use by musicians. A further advantage arises in that the rounded edge of the ridge can be hit from a variety of drumstick impact angles and produce the same desired result. The presence of the ridge 20 on bell 10 also tends to reduce unwanted overtones giving the instrument a desired tone.

While there has been described what is believed to be the preferred embodiment of the invention, those skilled in the art will recognize that other and further modifications may be made thereto without departing from the spirit of the invention, and it is intended to claim all such changes and modifications as fall within the scope of the invention.

I claim:

1. A cow-bell percussion instrument comprising:

a hollow body formed of sheet metal, said hollow body having a closed end and an open end, said open end being generally rectangular in shape, and a striking ridge separately attached along one of the longer sides of said rectangular open end, said ridge being formed of a durable material capable of reducing unwanted overtones generated by said cow-bell, when said ridge is struck.

2. The cow-bell as specified in claim 1 wherein said ridge is riveted to said body.

3. The cow-bell as specified in claim 1 wherein said ridge is formed as a solid piece of high-impact molded plastic having one side shaped to conform to the exterior surface of said body along said longer side.

4. The cow-bell as specified in claim 3 wherein said ridge includes a flange portion extending over the edge of said cow-bell along said longer side.

5. The cow-bell as specified in claim 1 wherein said ridge has an outwardly facing surface which is tapered toward said closed end and rounded toward said open end.

6. A cow-bell percussion instrument comprising a hollow body formed of sheet metal and having a generally rectangular cross section between longitudinally opposite open and closed ends and a striking ridge formed of high-impact molded plastic having an interior surface conforming to a portion of the surface of said hollow body adjacent said open end and being rigidly mounted to said body to extend along a selected portion of the edge of said sheet metal forming said open end.

7. A cow-bell as specified in claim 6 wherein said striking ridge has an outwardly facing surface which is tapered toward said closed end and rounded toward said open end.

8. A cow-bell as specified in claim 7 wherein said selected portion extends along a longer edge of said opening.

* * * * *